United States Patent [19]

König et al.

[11] Patent Number: 4,727,713

[45] Date of Patent: Mar. 1, 1988

[54] ROVING OR SLIVER CLAMPING DEVICE FOR A DRAFTING FRAME OR A SPINNING MACHINE

[75] Inventors: Herbert König, Ebersbach; Werner Meissner, Hattenhofen, both of Fed. Rep. of Germany

[73] Assignee: Zinser Textilmaschinen GmbH, Ebersbach, Fed. Rep. of Germany

[21] Appl. No.: 20,105

[22] Filed: Feb. 27, 1987

[30] Foreign Application Priority Data

Feb. 28, 1986 [DE] Fed. Rep. of Germany ..... 3606609

[51] Int. Cl.[4] ..... D01H 13/18; D01H 13/14

[52] U.S. Cl. ..... 57/84; 19/0.25; 57/81; 57/87

[58] Field of Search ..... 57/80, 81, 84–87; 19/0.25

[56] References Cited

U.S. PATENT DOCUMENTS 3,517,497 6/1970 Rettenmund ..... 57/84 X
4,501,114 2/1985 von Ronai-Horvath et al. ... 57/86 X
4,519,199 5/1985 Barauke ..... 57/87
4,630,434 12/1986 Hartmannsgruber et al. ..... 57/87

FOREIGN PATENT DOCUMENTS 3406397 7/1985 Fed. Rep. of Germany .
3048481 10/1985 Fed. Rep. of Germany .

*Primary Examiner*—John Petrakes
*Attorney, Agent, or Firm*—Karl F. Ross; Herbert Dubno

[57] ABSTRACT

Roving or sliver clamping device at the drafting unit of a spinning machine, with a clamp segment which enters in the operative position between the upper inlet roller and the lower inlet roller of the drafting unit, and which clamp segment raises the upper inlet roller from the lower inlet roller, and clamps the roving or sliver against the upper inlet roller, whereby the clamp segment is acted upon by an actuating element which causes its roving or sliver-clamping position, and the clamp segment is maintained in the position in which the roving or sliver clamping device is at rest by a holding element. The holding element includes means for storing energy and it positively counteracts the actuating element.

7 Claims, 6 Drawing Figures

ROVING OR SLIVER CLAMPING DEVICE FOR A DRAFTING FRAME OR A SPINNING MACHINE

CROSS REFERENCE TO RELATED APPLICATIONS

This application is related to the commonly assigned copending applications, Ser. No. 889,333, filed July 23, 1986 (now U.S. Pat. No. 4,656,822), and Ser. No. 892,719, filed July 31, 1986.

FIELD OF THE INVENTION

Our present invention relates to a roving or sliver clamping device at the drafting frame of a spinning machine, and, more particularly, to a device of the type in which a clamp segment is moved between an upper inlet roller and a lower inlet roller of the drafting frame or unit of the spinning machine.

BACKGROUND OF THE INVENTION

In earlier devices of this type, the clamp segment raises the upper inlet roller from the lower inlet roller and secures the roving or sliver against the upper inlet roller. The clamp segment is acted upon by an actuating element which brings it into its roving or sliver-clamping position. The clamp segment is maintained by a holding element in the position in which the roving or sliver clamping device is in its inoperative position or at rest, i.e. the roving or sliver releasing position.

A roving or sliver clamping device of this kind is known in which the clamp segment is provided with a coupling-type projection which, in turn, engages the counter-piece of a support rail which is spring-biased (German Pat. No. 34 06 397).

The support rail, in turn, is connected to a solenoid which serves to release the latch so that, due to the force of the spring and with the correlated rotation of the lower inlet roller, the clamping segment enters between the roving or sliver and the lower inlet roller and raises the upper inlet roller out of the contact with the lower inlet roller while clamping the roving or sliver against the upper inlet roller.

Another roving or sliver clamping device of this general kind includes a contact formation which locks a lever. On release the lock the clamp segment is taken along in the direction of rotation by the lower inlet roller, and the supply of roving or sliver is stopped (German Pat. No. 30 48 481).

Due to their particular structures, the prior art devices briefly described in the foregoing do not always ensure a fully satisfactory action which will ensure that the respective components are positively moved from the released position into the clamped position or condition, i.e. assume the position in which the upper inlet roller is lifted from the lower inlet roller and in which the roving or sliver or roving is pressed against the upper inlet roller.

Practical experience has shown that the respective catch elements which absorb the operational pressure or impact sometimes jam due to the exerted pressure and do not positively or assuredly disengage when this is necessary.

OBJECTS OF THE INVENTION

It is, therefore, the principal object of the present invention to provide an apparatus which precludes the disadvantages and problems of the prior art.

It is also an object of the invention to provide a roving or sliver clamping device with which a certain shaft from the released to the clamping position is ensured.

It is further an object of the invention to provide a roving or sliver clamping device in which the clamp segment is more positively brought into its operative position.

SUMMARY OF THE INVENTION

The foregoing and other objects and advantages of the invention are attained, in accordance with the invention, in that the holding element includes means for storing energy and that it positively counteracts the action of the actuating element.

The apparatus has been formed, as a result, to have a very high operational accuracy, i.e. the roving or sliver clamping device of the invention substantially precludes jamming and similar undesired functional disruptions during its operation.

Thus the roving or sliver clamping device for use at the drafting unit of a spinning machine, according to the invention, comprises clamp means which in the operative condition enters between the upper inlet roller and the lower inlet roller of the drafting unit by raising the upper inlet roller from the lower inlet roller, and which secures the roving or sliver against the upper inlet roller, actuating means interacting with the clamp means so as to bring the clamp means into the operative condition in which roving or sliver clamping is effected, and holding means which selectively interacts with the clamp means so as to maintain the clamp means at rest, the holding means being capable of retaining the clamp means with a force which is sufficient to at least maintain the actuating means in its inoperative condition. The holding means is provided with force-storing means generating a force counteracting the action of the actuating means and capable of selectively providing retaining energy at a rate such that when the actuating means imparts its operative energy, the holding energy of the holding means can be lowered to be less than the energy exerted by the actuating means on the clamp means.

For actuation of the clamp means the force exerted by the actuating means on the clamp means can be selectively raised to a level which is greater than the level of force stored by the holding means and exerted by it on the clamp means.

The actuating means and the holding means can include at least one permanent magnet, and the force exerted by a permanent magnet on the clamp means can be selectively varied by a solenoid system.

The device can further include at least one piston and cylinder unit which assist in performing the function of one of the actuating means and the holding means, and means for selectively varying the pressurization of the piston and cylinder unit.

We can provide at least one spring which assists in performing the function of one of the actuating means and the holding means.

The actuating means and the holding means can include cooperating permanent magnets, and the polarity of at least one permanent magnet can be reversed by a coil in such a way that the clamp means is moved from the rest position into the operative position. The actuating means and the holding means are unitized in a selectively acted upon hydraulic or pneumatic piston and cylinder unit.

In other words, the roving or sliver clamp device at the drafting unit of a spinning machine can include a clamp segment which enters in the operative condition between the upper inlet roller and the lower inlet roller of the drafting device, and which clamp segment raises the upper inlet roller from the lower inlet roller, and clamps the roving or sliver against the upper inlet roller, whereby the clamp segment is actuated by an actuating element which causes its roving or sliver-clamping position, and the clamp segment is maintained in the roving-released position in which the roving or sliver clamp is at rest by a holding element. According to the invention the holding element includes means for storing energy and it positively counteracts the force of the actuating element.

BRIEF DESCRIPTION OF THE DRAWING

The above and other objects, features and advantages will become more readily apparent from the following description, reference being made to the accompanying highly diagrammatic drawing in which.

SPECIFIC DESCRIPTION

Figure 1:
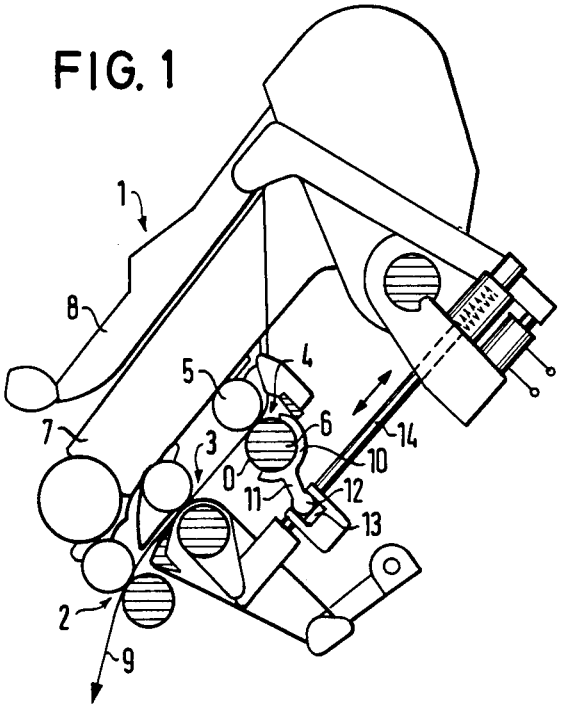
FIG. 1 is a schematic side elevation of a drafting unit with the clamp segment in the released condition.

FIG. 1 schematically indicates the drafting unit at a spinning machine. The spinning machine, not shown in detail, has a plurality of spinning stations (also not shown in detail) as is known in the art, but each spinning station includes a drafting unit 1.

Each drafting unit 1 typically includes an exit roller pair 2, an intermediate or small-belt type roller pair 3, as well as an inlet roller pair 4, the latter being comprised of the upper inlet roller 5 and the lower inlet roller 6.

The upper rollers of the mentioned pairs are journalled in the pressure arm 7 which exerts the operative downward pressure on the roving between the rollers of each pair. The pressure arm 7, in turn, is actuated by the swing arm 8.

The lower inlet roller 6 is partially encased or surrounded by a clamp segment 10 which can be rotated about the axis "O" (the longitudinal rotation axis of the roller 6 in the drawing). The clamp segment 10 is part of a lever arm 11 which has a lower spherical formation 12. The spherical formation or pawl 12 can engage in a jaw-type bearing formation 13 of an actuating rod 14.

As is indicated by the double-headed arrow in FIG. 1, the actuating rod 14 can be reciprocatingly moved for correspondingly moving the lever arm 11.

Thus, when the actuating rod 14 is moved to the right in the inclined manner suggested in FIG. 1, the clamp segment 10 is moved out of the release or rest position shown into the operative position, by rotating counter clockwise about the axis or point of rotation "O" and due to the interaction of bearing formation 13, the spherical formation 12, and the lever arm 11.

When the clamp segment 10 has attained the fully operative position, the upper inlet roller 5 is lifted away from the lower inlet roller 6, but the roving or sliver or roving is firmly pressed against the upper inlet roller 5. The upper roll of the next roller pair 3 can be lifted correspondingly.

Figure 2:
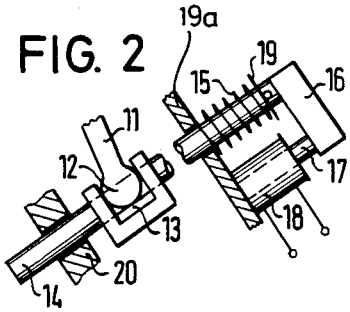
FIG. 2 is an enlarged detail at the actuating rod of the apparatus, shown partially in cross section.

Actuation of the actuating rod 14 according to FIG. 2 is by way of a coil spring 15 which surrounds the right or upper end of the actuating rod 14. The right end of the spring 15 abuts against the stop 19, and the other (left) end of the spring 15 abuts against the wall 19*a*. The actuating rod 14 is held in the rest position of the system by way of an armature 16, a coil core 17, and an energized solenoid 18, with the coil spring 15 being tensioned by being compressed against the wall 19*a*.

When required, e.g. because of yarn breakage, the solenoid 18 is operated (e.g. deenergized) so as to release the armature 16. Because the spring 5 abuts the stop 19 at the actuating rod 14, the released tension of the spring 15 moves the actuating rod 14 to the right, in inclined manner, and the clamp segment 10 is brought into the operative position due to its rotation or turning about the point "O".

When, however, the coil core 17 is a permanent magnet, the armature 16 can be released when the retentivity of the permanent magnet 17 is decreased by energization of the coil. This can be achieved by supplying direct current only at a magnitude such that the force or tension of the spring 15 is greater than the retentivity acting on the armature 16. Consequently, the actuating rod 14 is moved so that the clamp segment 10 secures the roving or sliver 9.

Thus, actuation of the roving or sliver clamping device is done by lowering the force of the holding means of the device to an amount which is less than the force exerted by the actuating element, i.e. the spring 15. The force of the spring 15 positively and accurately brings the device into the operative condition.

Figure 3B:
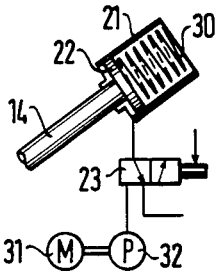
FIGS. 3*a* and 3*b* are diagrams showing a valve control for the actuating rod.
Figure 3A:
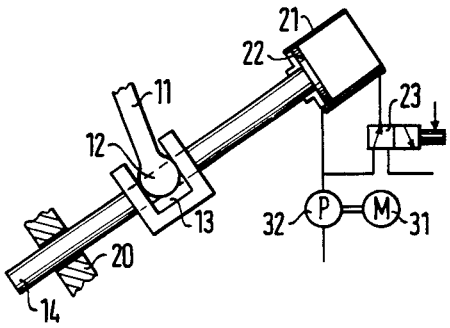

In the embodiments of FIGS. 3*a* and 3*b* use is made of piston and cylinder units 21 and 22. In accordance with FIG. 3*a*, the actuating rod 14 has a piston formation 22 which is reciprocatingly arranged in the cylinder 21. By means of a control valve 23, the piston formation 22 and, of course, the actuating rod 14 can be operated to perform the described motions of the roving or sliver clamping device.

The control valve 23 in this embodiment is connected to a pump 32 and a motor 31 for the pump 32.

As indicated in FIG. 3*a*, the pump 32 supplies the respective pressure medium and the control valve 23 directs the pressure medium to the right input side of the piston formation 22 in the cylinder 21. The actuating rod 14 is then positioned (to the left) so as to maintain the roving or sliver clamping device in the rest position. On reversing the action of the control valve 23, the respective pressure medium is introduced at the left input side of the piston formation 22, due to the action of the motor 31 and the pump 32. The actuating rod 14 is then moved (to the right) so as to bring the roving or sliver clamping device into the operative condition, by way of the jaw formation 13, the spherical formation 12, and the lever arm 11, the latter turning the clamp segment 10 about the axis or point of rotation "O".

In the embodiment according to FIG. 3*b*, the actuating rod 14 is further biased by a spring 30 which is disposed in the cylinder 21. Thus, in the released or rest position of FIG. 3*b*, i.e. roving or sliver clamping device is at rest, the spring 30 is pressed on the right input side of the piston formation 22. When the control valve 23 reverses the operation, the pressure medium is brought, by way of the motor 31 and the pump 32, into the cylinder 21, but at the left input side and the actuating rod 14 is moved to the right in the illustrated inclined manner, i.e. the clamp segment 10 and, consequently, the roving or sliver clamping device are shifted into the operative position or condition.

Figure 4:
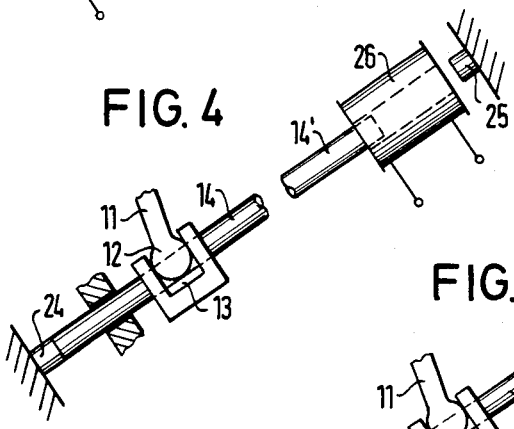
FIGS. 4 and 5 show magnetic control for the actuating rod.

In the embodiment of FIG. 4 actuation is by way of two permanent magnets, i.e. a left or lower permanent magnet 24 and a right or upper permanent magnet 25. The actuating rod 14 is equipped at its right hand end with a soft-iron core 14' which extends operatively in the solenoid 26, and the latter can be operated with direct current.

The position of the various elements in FIG. 4 corresponds to the released or rest condition of the actuating rod 14 and the roving or sliver clamping device is also at rest. Accordingly, the left permanent magnet 24 firmly retains the actuating rod 14. When the solenoid 26 is supplied with a respective direct current voltage, the retentivity of the permanent magnet 24 is overcome, and the actuating rod 14 brings the clamp segment 10 into the operative position due to the attraction of the right permanent magnet 25. The actuating rod 14, i.e. the soft-iron core 14' is then firmly retained at the right permanent magnet 25.

Through application of the respective direct current voltage at the solenoid 26, the actuating rod 14 can again be released from the right permanent magnet 25, moved to the left, and attached at the left permanent magnet 24. When this occurs, the actuating rod 14 and the roving or sliver clamping device are returned from the operative condition into the rest condition.

Instead of two permanent magnets—one at each end of the actuating rod 14 as described—one can use only one permanent magnet at one end, and the other side can be biased by a spring which acts against a stop.

Figure 5:
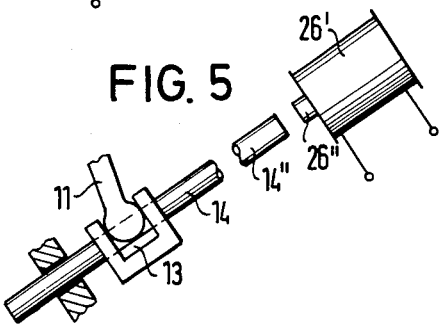

The embodiment of FIG. 5 has two cooperating permanent magnets 14" and 26" which respectively function as the lock element and the release element. The polarity of at least one of these two permanent magnets can be selected, by control of a solenoid or solenoid coil 26', in such a way that the clamp segment 10 is brought from the released position, i.e. roving or sliver clamping device is at rest, into the active or operative position. For this, the permanent magnet 14", which is part of the actuating rod 14, can be selected as the north pole, for example. The solenoid 26' can reverse the polarity of the permanent magnet 26" so that it has either north or south polarity, and movement of the actuating rod 14 is achieved correspondingly, for the respective turning or swinging motion of the clamp segment 10.

In all described embodiments, the stored energy or force in the holding means counteracts the energy force of the actuating means or element, and a positive movement of the actuating rod 14 for movement of the clamp segment 10 is achieved. Consequently, a reliable operation of the roving or sliver clamping device is guaranteed.

We claim:

1. A roving clamping device for use in a drafting unit of a spinning machine, said drafting unit having an upper inlet roller and a lower inlet roller engaging a roving between them, said device comprising:

clamping means swingable to enter between said upper inlet roller and said lower inlet roller to raise the upper inlet roller from the lower inlet roller for clamping a roving against said upper inlet roller in an operative position of said clamping means;

actuating means operatively connected with said clamping means and including a first force-generating element biasing said clamping means in a direction of movement into said operative position and freely shiftable in said direction at all times by a first force contributed by said element; and holding means for retaining said actuating means against said force for holding said actuating means against movement in said direction solely by force balance and without a mechanical locking of said actuating means, said holding means including:

a second force-generating element operatively coupled to said actuating means for generating a second force acting counter to said first force contributed by said first force-generating element, and means connected to one of said force-generating elements for controlling same to relieve the effect of said second force and release said actuating means so that said first force can insert said clamping means between said upper inlet roller and said lower inlet roller.

2. The device defined in claim 1 wherein said means connected to said one of said force-generating elements is constructed and arranged to reduce said second force to a level below said first force to release said actuating means.

3. The device defined in claim 1 wherein said means connected to said one of said force-generating elements is constructed and arranged to increase said first force to release said actuating means.

4. The device defined in claim 1 wherein at least one of said force-generating elements includes a permanent magnet and the force exerted by said permanent magnet is varied by an electromagnetic coil forming said means connected to said one of said elements.

5. The device defined in claim 1 wherein one of said force-generating elements includes a piston-and-cylinder unit and said means connected to one of said elements for controlling same includes means for selectively varying pressurization of said unit.

6. The device defined in claim 1 wherein at least one of said force-generating elements consists of a spring generating one of said first and second forces.

7. The device defined in claim 1 wherein said first and second force-generating elements consist of respective permanent magnets and said means connected to one of said elements includes a coil for reversing the polarity of one of said electromagnets.

* * * * *